US008733898B2

(12) United States Patent
Kusunoki

(10) Patent No.: US 8,733,898 B2
(45) Date of Patent: May 27, 2014

(54) INK JET HEAD, NOZZLE PLATE THEREOF AND PRINTING METHOD USING THE SAME

(75) Inventor: Ryutaro Kusunoki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 618 days.

(21) Appl. No.: 12/718,916

(22) Filed: Mar. 5, 2010

(65) Prior Publication Data

US 2010/0238215 A1 Sep. 23, 2010

(30) Foreign Application Priority Data

Mar. 18, 2009 (JP) ..... 2009-66773

(51) Int. Cl.
*B41J 2/14* (2006.01)

(52) U.S. Cl.
USPC ..... 347/47; 347/71; 347/69

(58) Field of Classification Search
USPC ..... 347/47, 69, 71
See application file for complete search history.

(56) References Cited

U.S. PATENT DOCUMENTS

| | | | |
|---|---|---|---|
| 4,513,299 | A | 4/1985 | Lee et al. |
| 6,142,607 | A | 11/2000 | Takata et al. |
| 6,467,882 | B2 | 10/2002 | Inui et al. |
| 2006/0119663 | A1 | 6/2006 | Tsuchii |
| 2006/0176338 | A1 | 8/2006 | Deguchi et al. |
| 2007/0103511 | A1 | 5/2007 | Takahashi |

FOREIGN PATENT DOCUMENTS

| | | |
|---|---|---|
| EP | 1437223 | 7/2004 |
| JP | 05-116313 | 5/1993 |
| JP | 11-020146 | 1/1999 |
| JP | 2001-088328 | 4/2001 |
| JP | 2001-315334 | 11/2001 |
| JP | 2007-062367 | 3/2007 |
| JP | 2008-87367 | 4/2008 |
| WO | WO-00/29217 | 5/2000 |

OTHER PUBLICATIONS

European Search Report EP 10156141.3, dated Jun. 23, 2010.
English machine translation of 11-020146, publication date Jan. 26, 1999.
English machine translation of 2001-088328, publication date Apr. 4, 2001.
English machine translation of 2001-315334, publication date Nov. 13, 2001.

*Primary Examiner* — Julian Huffman
(74) *Attorney, Agent, or Firm* — Patterson & Sheridan, L.L.P.

(57) ABSTRACT

Disclosed is an ink jet head for ejecting an ink droplet to form an image on a recording medium, including a pressure chamber to which ink is supplied, an actuator which applies a pressure on the ink filled in the pressure chamber to eject the ink droplet, a circuit applying to the actuator a drive-waveform for sequentially ejecting one or more ink droplets to form one pixel, the one ink droplet having V in volume, and a nozzle plate which has a nozzle fluidly communicating with the pressure chamber to eject ink droplet therefrom, the nozzle having a stepped inner surface shaped to include an inlet communicating with the pressure chamber and having a first sectional area in an orthogonal plane to ink-ejecting direction, and to include an outlet communicating with the inlet and having a length Ln1 in the ink-ejecting direction and a second sectional area C1 in the orthogonal plane smaller than the first sectional area, the Ln1, C1, and V being satisfied the relationship of $0.5 \leq Ln1/(V/C1) \leq 1.0$. The ink jet head provides a high print quality while preventing a variation in volume of ink droplet ejected from the nozzle.

13 Claims, 6 Drawing Sheets

INK JET HEAD, NOZZLE PLATE THEREOF AND PRINTING METHOD USING THE SAME

CROSS REFERENCE TO RELATED APPLICATIONS

This application is based upon and claims the benefit of priority from the prior Japanese Patent Application No. 2009-66773 filed on Mar. 18, 2009, the contents of which are incorporated herein by reference.

BACKGROUND

1. Technical Field

The disclosure described herein relates, in general, to an on-demand ink jet head ejecting continuously a plurality of ink droplets to form one pixel on a recording medium. The disclosure specifically relates to an ink jet head having a nozzle plate in which a nozzle having a stepped inner surface is formed.

2. Description of the Related Art

An ink jet head including a plurality of nozzles to eject ink droplets is widely utilized in a home appliance, e.g. ink jet printer. The ink jet head includes a substrate, a spacer formed like a frame adhered to the substrate, and a nozzle plate adhered to the spacer. The substrate, spacer and nozzle plate compose an ink flowing chamber in association with one another. In the ink flowing chamber, a piezoelectric member is provided as an actuator to cause an ink droplet to be ejected from the nozzle plate in which a nozzle is formed.

The piezoelectric member has a plurality of grooves each of which opens towards the nozzle plate. The grooves are arranged in parallel at a predetermined distance. Grooves adjacent to each other are partitioned by a side wall made of the piezoelectric member. A room surrounded by inner surface of each groove and the nozzle plate forms an ink pressure chamber fluidly communicating with the ink flowing chamber. An electrode is deposited on the inner surface of the wall facing the ink pressure chamber.

The nozzle plate has a plurality of nozzles. Each nozzle defines a miniaturized hole in micron size, penetrating the plate. The nozzle is fluidly communicating with the ink pressure chamber in which the electrode is formed on the inner surface thereof.

When a drive voltage is applied to the electrodes, the two side walls faced with each other, interposing one ink pressure chamber, deform in chevron to mutually approach and move apart, for example. Such deformation of the side walls causes ink filled in the one ink pressure chamber to be compressed. As a result, ink in the one ink pressure chamber is ejected out of the nozzle to a recording medium.

Generally the nozzle for ejecting ink is tapered such that diameter of the nozzle gradually decreases in a direction of ink ejection. However it is difficult to drill the tapered nozzle accurately. When a solid material, e.g., silicon, is processed to form a nozzle plate, variation in size of the nozzles tends to occur, even if dry-etching process is utilized to drill the nozzle.

Japanese Laid-open Patent Application No. 2008-87367 (hereinafter called as "JP '367") discloses an inkjet head having an orifice (nozzle) plate made of silicon. The orifice plate has a nozzle and nozzle communication portion formed in a stepped shape on an inner surface thereof (hereinafter called as "stepped nozzle"). The stepped nozzle is formed in a silicon plate by dry-etching process. The stepped nozzle is of straight hole such that a sectional area of the nozzle is smaller than that of the nozzle communication portion in a plane orthogonal to the direction of ink ejection. The orifice plate is attached to a fluid path substrate such that the nozzle locates at an ink ejection side of the plate and the nozzle communication portion locates at a side opposite to the ink ejection side (fluid path substrate side) in a direction of ink ejection.

In order to form the stepped nozzle, a SOI (Silicon-On-Insulator) substrate (orifice plate) in which a first silicon element, a silicon-dioxide thin film, and a second silicon element are layered in the order is etched from both surfaces thereof.

When the SOI substrate is etched to drill the nozzle and nozzle communication portion, the silicon-dioxide thin film serves as an etching stopper layer. The respective first and second silicon layers are grinded to adjust the thickness of each layer. Therefore, each depth of the nozzle and nozzle communication portion can be independently determined by controlling the amount of grinding the respective surfaces of the SOI substrate.

The shape of the nozzle and nozzle communication portion is realized by photolithographic process, resulting in high precision. For this reason, a variation in size can be suppressed in the stepped nozzle comparing to a tapered nozzle.

Ink jet printer equipped with an inkjet head is required to achieve higher print quality at all times. The print quality is affected by variation of an ink volume ejected from a nozzle of the inkjet head.

In the inkjet head having the stepped nozzle disclosed in JP '367, ink filled in the stepped nozzle is ejected to a recording medium when a drive voltage is applied to the ink jet head. Ink within the nozzle is sharply accelerated every time that the drive voltage is applied to eject ink.

The nozzle of the stepped nozzle serves as a fluid resistance when the accelerated ink is ejected through the nozzle. The fluid resistance depends on length of the nozzle in a direction of ink ejection. Thus, the length of the nozzle significantly affects the ejected ink droplet in its volume.

According to the conventional photolithographic process, an accurate shape of the stepped nozzle can be realized. However, since accuracy in length of the nozzle depends on performance of the machine process in which the surface of the substrate is ground or polished, it is difficult to obtain a highly accurate length of the nozzle. As a result, variation of the length of the nozzles causes an ink volume ejected to fluctuate, resulting in deterioration in a print quality.

SUMMARY

An aspect of the disclosure is to provide an inkjet head and nozzle plate realizing a high print quality by suppressing a variation of ink volume ejected.

One embodiment of an ink jet head for ejecting an ink droplet to form an image on a recording medium, comprising:

a pressure chamber to which ink is supplied;

an actuator which applies pressure on the ink filled in the pressure chamber;

a circuit which applies to the actuator a drive-waveform for sequentially ejecting one or more ink droplets to form one pixel on the recording medium, the one ink droplet having a volume V; and a nozzle plate which has a nozzle fluidly communicating with the pressure chamber to eject the ink droplet therefrom, the nozzle having a stepped inner surface shaped to include an inlet communicating with the pressure chamber and having a first sectional area in an orthogonal plane to ink-ejecting direction, and to include an outlet communicating with the inlet and having a length Ln1 in the ink-ejecting direction and a second sectional area C1 in the orthogonal plane smaller than the first sectional area, the Ln1, C1, and V being satisfied the relationship of $0.5 \leq Ln1/(V/C1) \leq 1.0$.

BRIEF DESCRIPTION OF THE DRAWINGS

This and other aspects and advantages of the disclosure will become apparent and more readily appreciated from the following detailed description taken in conjunction with the accompanying drawings wherein.

DETAILED DESCRIPTION

Figure 1:
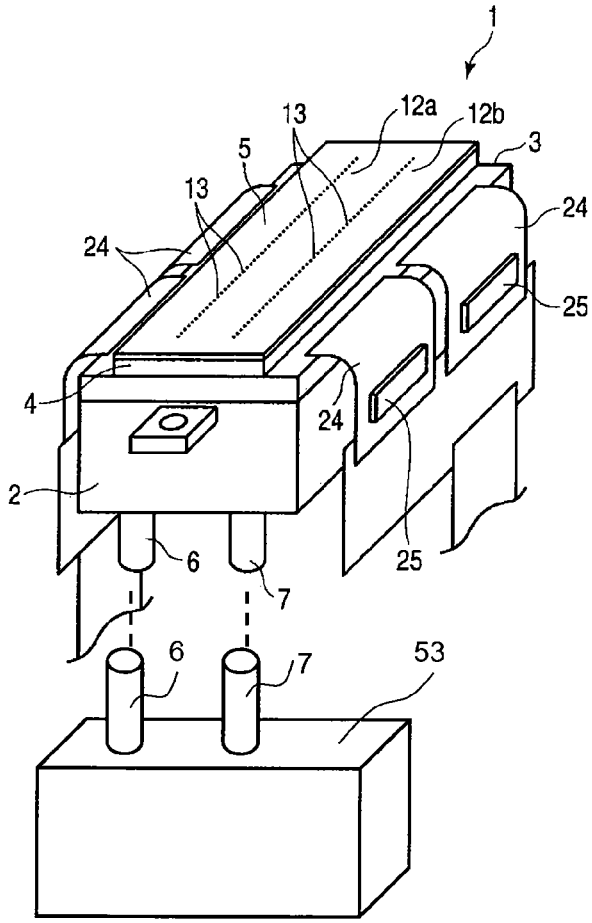
FIG. 1 is a perspective view illustrating an ink jet head according to an embodiment.

Preferred embodiments will now be described in more detail with reference to the accompanying drawings. However, the same numerals are applied to the similar elements in the drawings, and therefore, the detailed descriptions thereof are not repeated.

Figure 2:
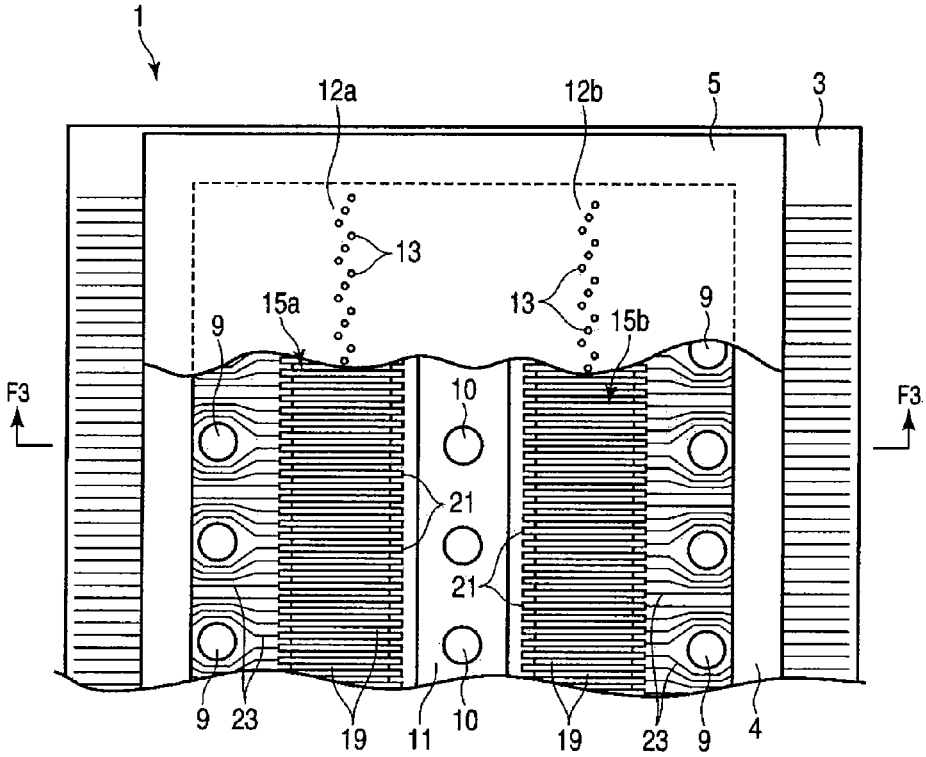
FIG. 2 is a plan view illustrating the ink jet head according to the embodiment.
Figure 3:
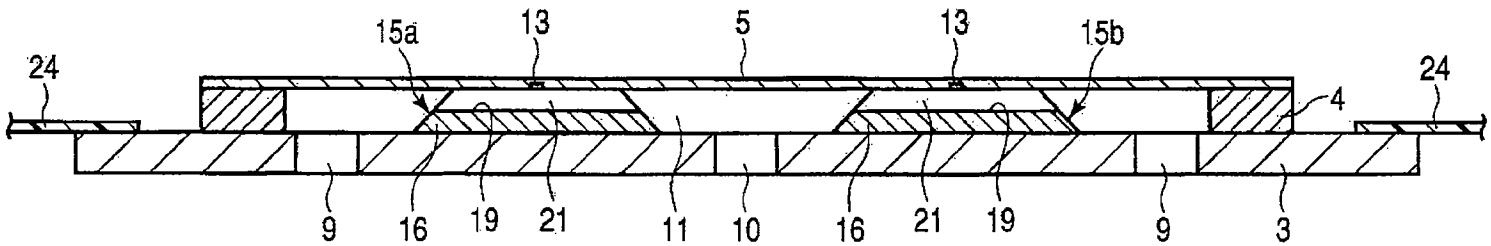
FIG. 3 is a sectional view taken along with F3-F3 line in FIG. 2.

FIGS. 1 to 3 illustrate an inkjet head 1 classified as an on-demand type. Inkjet head 1 is, for example, attached to a carriage of an inkjet printer to print an image. Inkjet head 1 includes an ink tank 2, a substrate 3, a spacer 4, and a nozzle plate 5.

Ink tank 2 is fluidly communicated with an ink-cartridge 53 by way of an ink supplying conduit 6 and an ink returning conduit 7.

Substrate 3 is attached to ink tank 2 to cover an opening of ink tank 2. Substrate 3 is made of ceramics and is shaped in, e.g., rectangle. A plurality of ink supply ports 9 and a plurality of ink discharge ports 10 are separately provided in substrate 3.

Ink supply ports 9 are arranged in line at a predetermined interval in a longitudinal direction of substrate 3. In this embodiment, two lines each including ink supply ports 9 arranged as above are provided at both sides of substrate 3 in parallel with one the other. Ink discharge ports 10 are aligned at predetermined intervals in parallel with the line of ink supply ports 9 at an equal distance from the two lines of the ink supply ports 9.

Spacer 4 is formed in a rectangular frame shape. Spacer 4 is adhered on substrate 3 using an adhesion, so that the frame shaped spacer 4 surrounds the two lines of ink supply ports 9 and ink discharge ports 10, as shown in FIG. 2.

Material of substrate 3 and spacer 4, includes, for example, one of an aluminum-oxide, a silicon-nitride, a silicon-carbide, an aluminum-nitride, and Lead-Zirconate-Titanate.

Nozzle plate 5 is formed in a silicon substrate which is harder than a resin film, e.g., polyimide film. Nozzle plate 5 is adhered on a surface of spacer 4 which is mounted on substrate 3, facing substrate 3.

Substrate 3, spacer 4, and nozzle plate 5 compose an ink flowing chamber 11 in association with one another. Ink flowing chamber 11 is fluidly communicated with ink tank 2 through ink supply port 9 and ink discharge port 10. Ink supply port 9 functions to supply ink from ink tank 2 to ink flowing chamber 11. When ink flowing chamber 11 runs over, excess ink returns to ink tank 2 via ink discharge port 10.

As shown in FIGS. 1 through 3, nozzle plate 5 includes a pair of nozzle rows 12*a* and 12*b* each having a plurality of nozzles 13. One of the nozzle rows 12*a* and 12*b* extends in a longitudinal direction of nozzle plate 5. The pair of nozzle rows is aligned in parallel at a predetermined interval in an orthogonal direction to the longitudinal direction, i.e., a width direction. Nozzles 13 are through holes each of which opens towards ink flowing chamber 11, on the one hand, and faces a recording medium, e.g., a recording paper, on the other hand.

Ink flowing chamber 11 accommodates a pair of actuator rows 15*a* and 15*b* each including a plurality of actuators. The pair of actuator rows 15*a* and 15*b* is formed on substrate 3. Each actuator row resides between lines of ink supply port 9 and ink discharge port 10. The pair of actuator rows 15*a* and 15*b* has an identical structure and function and therefore structure and function of one of the actuator rows 15*a* is described hereinafter. One of the actuator rows 15*a* is arranged on substrate 3 such that each pair of adjacent actuators in the actuator row has each one nozzle in the nozzle row 12*a*, respectively. In other word, one nozzle is assigned to the pair of adjacent actuators to eject ink. A bottom surface of actuators of the row 15*a* is adhered to substrate 3 and a top surface of actuators opposite to the bottom surface is adhered to an inner surface of nozzle plate 5.

Figure 4:
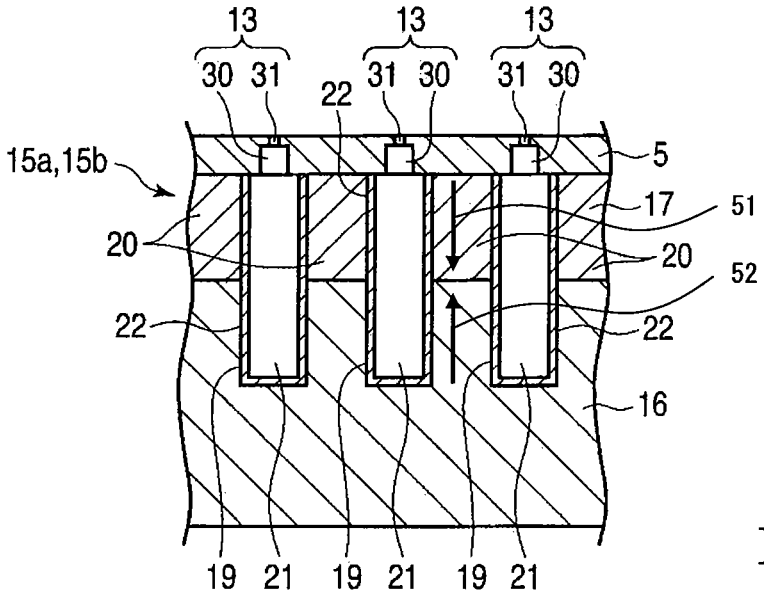
FIG. 4 is a sectional view indicating a positional relationship between a nozzle and an ink chamber according to the embodiment.

As shown in FIG. 4, actuator row 15*a* is formed of two piezoelectric plates 16 and 17, e.g., Lead-Zirconate-Titanate, which are layered. Piezoelectric plates 16 and 17 are respectively polarized in a thickness direction. The direction of the polarization of piezoelectric plates 16 and 17 is opposite to each other. Arrows 51 and 52 represent two polarization directions which are opposite to each other.

One pair of adjacent actuators of row 15*a* shapes a groove 19 which extends from plate 17 to plate 16. Other pairs of adjacent actuators also form such groove 19. One actuator is shared by adjacent two grooves 19. In other words, the one actuator serves as a side wall 20 partitioning the adjacent grooves.

A room defined by the pair of adjacent actuators (groove) and nozzle plate 5 constitutes a pressure chamber 21. Each pressure chamber 21 is fluidly communicated with ink flowing chamber 11 and with nozzle 13 drilled in nozzle plate 5. In this configuration, ink flowing through ink flowing chamber 11 is supplied to each pressure chamber 21.

Electrode 22 is formed on inner surface of groove 19, i.e., each surface of adjacent side walls 20 facing pressure chamber 21 and a bottom surface of pressure chamber 21. Electrode 22 is electrically connected with a conductive pattern 23 formed on a top surface of substrate 3, as shown in FIG. 2. Insulating film not shown in FIGURES covers electrode 22 patterned within spacer 4.

As shown in FIG. 2, a leading edge of each conductive pattern 23 extends up to the outside of spacer 4 on a top surface of substrate 3. The leading edge is connected with printed circuit patterned on a flexible print circuit 24. A drive circuit 25 for driving inkjet head is mounted on flexible print circuit 24. A plurality of flexible print circuits each having drive circuit 25 are provided to inkjet head 1, as shown in FIG. 1.

Drive circuit 25 applies a drive voltage to electrode 22 through conductive pattern 23 within inkjet head 1. The drive voltage generates a potential difference between electrodes 22 of adjacent pressure chambers 21 interposing one side wall 20, resulting in producing electric field in the one side wall 20. Since side wall 20 is made of two piezoelectric materials having opposite polarization to each other, the electric field causes the one side wall 20 to deform in chevron due to shear mode deformation of piezoelectric material. When a positive voltage is applied to two adjacent side walls 20 interposing pressure chamber 21, both of the two side walls 20 deform in chevron to expand a volume of pressure chamber 21 therebetween. Therefore, ink is further supplied to the expanded pressure chamber 21. Applying positive voltage means that a first electrode 22 provided on the inner surface of a first pressure chamber 21 interposed between the two side walls 20 is grounded and a second electrode 22 provided on the inner surface of a second pressure chamber 21 adjacent to the first pressure chamber 21 is applied with the positive voltage.

Following the application of the positive voltage to the side walls 20, when the voltage goes off, side walls 20 return to the initial state. The return of side walls 20 causes pressure chamber 21 to compress ink filled in pressure chamber 21. Ink within pressure chamber 21 is not substantially compressed and ink forcibly moves toward opening. Therefore, a part of compressed ink within pressure chamber 21 is ejected from nozzle 13 to become a droplet flying to recording medium.

Figure 6:
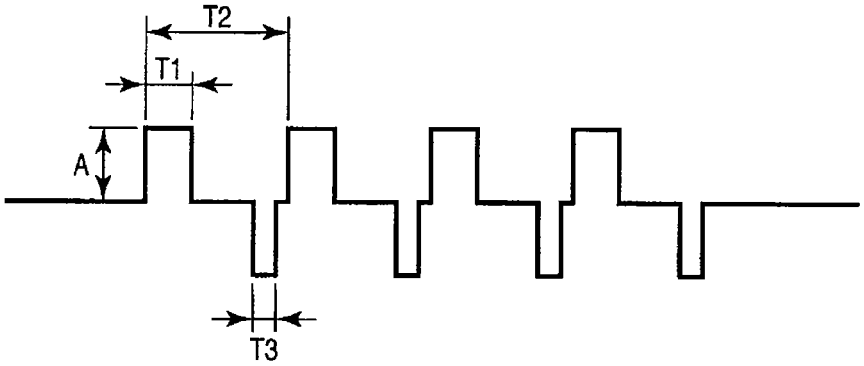
FIG. 6 is a drive waveform applied to an actuator to eject droplets from a nozzle according to the embodiment.

An inkjet printer equipped with inkjet head 1 of the present embodiment forms a single pixel by sequentially ejecting a plurality of ink droplets from pressure chamber 21 at a predetermined period. The number of ink droplets to form the single pixel is determined according to a level of tone assigned to the pixel. FIG. 6 illustrates a drive waveform applied to drive circuit 25 of inkjet head 1 to form a single pixel. The inkjet printer renders a pixel having plural levels in optical density in halftone image.

In the drive waveform in FIG. 6, T1 denotes an ejecting time which is required to eject one ink droplet. T2 denotes a period at which an ink droplet is ejected. A denotes a drive voltage applied to electrode 22. Namely, in the present embodiment, ink compressed in pressure chamber 21 is ejected four times at T2 period to form a single pixel on a recording medium. Ink droplets ejected respectively require ejecting time T1.

Besides, every time that ink ejection of a single ink droplet is completed, a cancellation pulse T3 is applied to electrode 22. The cancellation pulse has a negative voltage to cancel a pressure vibration generated in ink within pressure chamber 21 due to the ink ejection.

Needless to say, if polarization direction of the two piezoelectric plates 16 and 17 is opposite to the above description, a negative voltage is applied to eject ink and a positive voltage is applied to cancel the pressure vibration in ink.

Configuration of nozzle plate will now be described.

Figure 5:
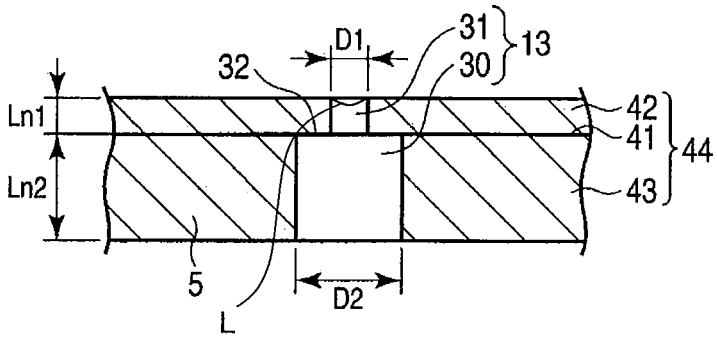
FIG. 5 is an enlarged sectional view illustrating a nozzle shape of the embodiment.

Each nozzle 13 for ejecting ink to the recording medium includes a stepped hollow inner surface therein as shown in FIGS. 4 and 5. Specifically nozzle 13 is shaped to include an inlet 30 communicating with pressure chamber 21, and an outlet 31 locating at a downstream side from inlet 30 in an ink ejecting direction.

Inlet 30 is cylindrically drilled from, for example, a predetermined surface of nozzle plate 5 in a thickness direction and is shaped not to penetrate nozzle plate 5. That is to say, inlet 30 has a bottom surface in nozzle 13. Outlet 31 is also cylindrically drilled to extend from the other surface of nozzle plate 5 to the bottom surface. Inlet 30 and outlet 31 are concentrically aligned and are fluidly communicated with one the other. Inlet 30 cylindrically formed has a second diameter D2 and has the same diameter D2 over its length.

Outlet 31 also has a first diameter D1 smaller than that of diameter D2 of inlet 30 and has the same diameter D1 over its length (depth).

A fabrication process of the above-described configuration of nozzle plate will be disclosed later.

For the above-described nozzle configuration, a step formed due to a difference in diameter between inlet 30 and outlet 31 resides naturally at a connecting portion (bottom surface) between inlet 30 and outlet 31.

Inlet 30 functions, as a conductive duct, to lead ink within pressure chamber 21 to outlet 31. Outlet 31 functions, as an orifice, to discharge ink supplied from inlet 30.

Although outlet 31 is a minute hole, outlet 31 requires sufficient amount of ink which is supplied through inlet 30. Therefore, it is preferable to set the second diameter D2 of inlet 30 twice or more the first diameter D1 of outlet 31.

A length Ln1 of outlet 31 is fabricated to be shorter than a length Ln2 of inlet 30 along with the ink-ejecting direction. A surface of ink supplied into outlet 31 forms an ink meniscus (L) at a front end (ink ejection end) of outlet 31 as shown in FIG. 5. The ink meniscus reciprocally moves in outlet 31 every time that ink is ejected from the nozzle.

A nozzle fabrication process will be described.

A nozzle plate 5 including stepped nozzle 13, as shown in FIG. 5, consists of a first single-crystal silicon layer 42, a second single-crystal silicon layer 43, and a silicon-oxide film 41 sandwiched between the silicon layers 42 and 43. The first and second single-crystal silicon layers 42 and 43, and silicon-oxide film 41 constitutes a SOI wafer 44 (Silicon-On-Insulator). Stepped nozzle 13 is formed by etching SOI wafer 44 from both side surfaces, i.e., one side from which ink droplet is ejected and the other side through which ink is led from pressure chamber 21.

Specifically, first and second single-crystal silicon layers of SOI wafer 44 are firstly machined to cut the respective layers and polish the surface thereof. By the machine process, a thickness of first single-crystal silicon layer 42 is sized to Ln1 and a thickness of second single-crystal layer 43 is sized to Ln2.

Secondly, dry-etching process is implemented to the surface of second single-crystal silicon layer 43 by using Bosch process of a conventional photolithography to form a circular hollow having a diameter D2. Silicon-oxide film 41 functions as an etching-stopper layer to control the depth of the hollow. Thus silicon-oxide film 41 prevents the dry-etching process from making an excess deep hollow.

Thirdly, the above dry-etching process is also applied to the surface of first single-crystal silicon layer 42, resulting in a hole having a diameter D1. Since silicon-oxide film 41 also functions as an etching-stopper layer to control the depth of the hole, outlet 31 is formed in SOI wafer 44.

Finally, silicon-oxide film 41 is decomposed and removed by hydrofluoric acid. As a result, a part of silicon-oxide film 41 exposed to hydrofluoric acid is pierced to make inlet 30 fluidly communicate with outlet 31.

Alternatively other process may be applied to form the stepped nozzle, wherein outlet 31 is firstly formed and then inlet 30 is formed.

Besides, a water repellent layer is provided on the surface of first single-crystal silicon layer 42. The water repellent layer serves to maintain cleanness of the surface of first single-crystal silicon layer 42. Ink ejected from nozzle plate 5 does not reside on plate 5.

Length Ln1 of outlet 31 and length Ln2 of inlet 30 are determined by cutting the first and second single crystal layers respectively and polishing the surfaces thereof. The cutting and polishing process is one of machining processes. The machine process, for example, may adversely produce a curve of SOI wafer 44 and have its limit of accuracy in thickness. A variation in thickness including some ±1 micron in length Ln1 of outlet 31 possibly occurs in the machine process. The variation in length Ln1 between respective outlets 31 of nozzles causes print quality to deteriorate. Especially in case that the number of ink droplets determines a level of tone in a pixel, a volume of ink ejected from a nozzle is extremely small, ranging from 1 pl to 10 pl (picoliter). Thus, the variation in length Ln1 between respective outlets 31 of nozzles causes the volume of ink ejected from respective outlets 31 to fluctuate with each other.

Deterioration of print quality means that an ink droplet ejected from the nozzle is displaced from a predetermined position on a recording medium, or a volume of an ink droplet ejected from the nozzle varies among plural outlets 13.

The inventor found a suitable range of the length Ln1. That is to say, even if a variation in the length Ln1 of plural outlets 31 somewhat takes place, if the variation of length Ln1 is controlled within the suitable range, a characteristic of ink ejection can be kept constant. The suitable range is especially effective to print a half-tone image in which respective pixels are formed with multiple droplets deposited on a recording medium.

The suitable range is found to be indicated by the following formulation. Where C1 denotes a sectional area of outlet 31 in an orthogonal plane to an ink-ejecting direction, V denotes an ink volume of one ink droplet ejected from outlet 31, and Ln1 denotes the length of outlet 31 along with the ink-ejecting direction. The suitable range requires the relationship represented by the following inequality. The ink volume V is determined by ink-ejecting time T1 and drive voltage of the drive waveform shown in FIG. 6. If the relationship between C1, V, and Ln1 indicated below is satisfied, a variation of the length Ln1 scarcely affects the characteristic of the ink ejection, e.g., ink volume ejected from outlet 31.

$$0.5 \leq Ln1/(V/C1) \leq 1.0$$

The ground for the relationship will now be described.

The inventor investigates how much the ink volume ejected from the outlet 31 varies, if diameter D1 of outlet 31 and ink-ejecting time T1 are changed on the condition that drive voltage A is kept constant. In the investigation, ink-ejecting speed is set to 10 m/sec, that is commonly known, and a sum of first and second lengths Ln1 and Ln2 is set to 50 μm (micrometer).

Figure 7:
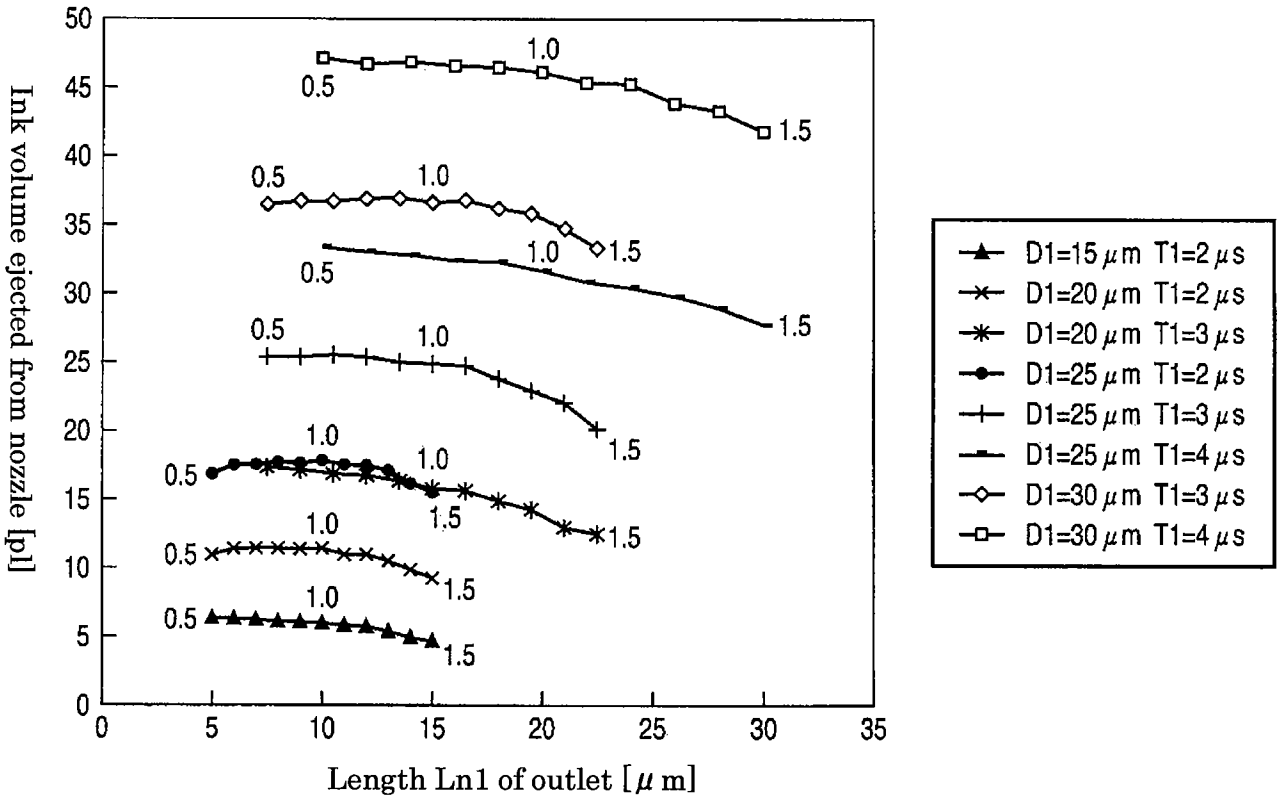
FIG. 7 is a graph indicating a relationship between a length of an outlet of a nozzle and ink volume ejected from the nozzle when a diameter of the outlet and ejecting time for an ink droplet are changed.

FIG. 7 indicates the relationship between an ink volume V ejected from outlet 31 and the length Ln1 of outlet 31. The abscissa represents the length Ln1 (micron) of outlet 31. The ordinate represents an ink volume V ejected from outlet 31. A first value V/C1 indicates that the ejected ink volume is divided by the sectional area of outlet 31. The first value means a height of a hypothetical cylinder having a volume corresponding to an ejected ink volume V and having a sectional area C1. A value Ln1/(V/C1) defined by dividing the length Ln1 of outlet 31 by the first value means a ratio of the length Ln1 and the height of the hypothetical cylinder. In the FIGURE eleven levels of the ratios Ln1/(V/C1) are plotted in the range from 0.5 to 1.5.

An ink volume V per a single ink droplet is measured by the following method. An empty petri dish is prepared and weighted by a weighing scale. N ink droplets each of which is defined by the ink-ejecting time T1 are deposited onto the petri dish. The petri dish onto which ink droplets are accumulated is weighted again. Then, the weight difference between the empty dish and the dish on which ink is accumulated is measured and divided by the number N to result in a weight per an ink droplet. If specific gravity of ink is regarded as 1, ink weight per a single droplet corresponds to ink volume V. Alternatively the ink volume V can be measured by taking a photograph of a flying ink droplet ejected and image-processing the photograph to calculate the volume V.

With reference to FIG. 7, in case that diameter D1 of outlet 31 is formed 30 μm, if the ratio Ln1/(V/C1) is adjusted 1.0 or less, the ink volume ejected from outlet 31 can be kept approximately constant, even if the length Ln1 of outlet 31 somewhat varies.

Similarly, in case that diameter D1 of outlet 31 is formed 25 μm, if the ratio Ln1/(V/C1) is adjusted 1.0 or less, the ink volume ejected from outlet 31 can be kept approximately constant, even if the length Ln1 of outlet 31 somewhat varies.

Similarly, in case that diameter D1 of outlet 31 is formed 20 μm or 15 μm, if the ratio Ln1/(V/C1) is adjusted 1.0 or less, the ink volume ejected from outlet 31 can be kept approximately constant, even if the length Ln1 of outlet 31 somewhat varies.

In other words, in any case that the ratios V/C1 are made not less than 1.0 in diameter D1 ranging from 15 μm to 30 μm, variation of ink volume ejected tends to increase.

In case that the ratio becomes not more than 0.5, the smaller the diameter D1 of outlet 31 becomes, the shorter the length Ln1 of outlet 31 becomes. Where the diameter D1 of outlet is 15 μm, the length Ln1 of outlet 31 becomes less than 5 μm. The length Ln1 of outlet 31 being 5 μm is too short to manufacture. Therefore, it is preferable that a lower limited ratio is set to be 0.5.

In this embodiment, the ratio Ln1/(V/C1) is controlled to be within a range from 0.5 to 1.0. This configuration can prevent a volume of ejected ink from fluctuating, even if the length Ln1 of outlet 31 somewhat varies. Therefore, a characteristic of ink ejection and a volume of ink droplet can be stabilized, resulting in high print quality.

The various embodiments can be realized without exceeding the scope claimed below. The outlet of the nozzle is not limited to a straight hole having a constant diameter, but the outlet can be formed to slightly taper in inner surface thereof. A diameter of the tapered outlet is varied in an ink-ejecting direction. In this case, the sectional area C1 is preferably set to a representative sectional area, e.g., an average sectional area.

Besides, the lengths of the inlet and outlet in an ink-ejecting direction are not limited to the embodiment set forth above, the lengths of the inlet and outlet can be set equal.

Figure 8:
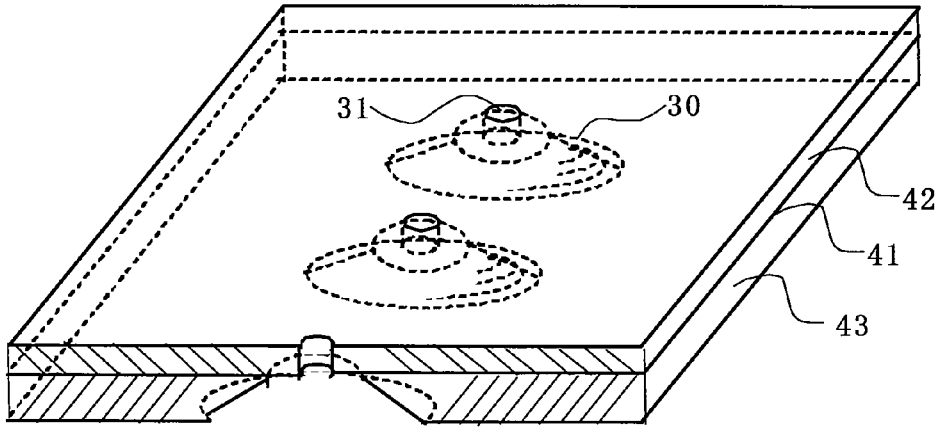
FIG. 8 is a perspective view illustrating another nozzle plate.
Figure 9:
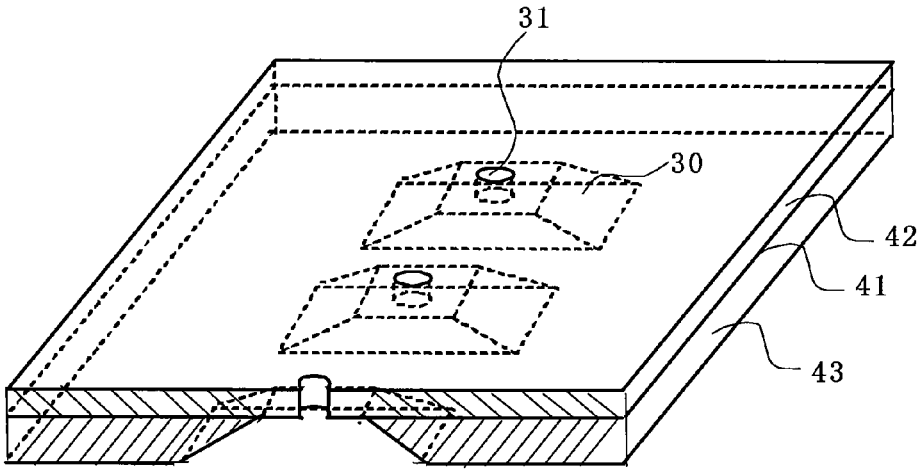
FIG. 9 is a perspective view illustrating another nozzle plate.

The inlet can be formed to be selected from hollow shape, concave shape, truncated cone shape, truncated quadrangular pyramid, and so on, as shown in FIGS. 8 and 9.

In place of the shear mode, a piezoelectric actuator operable in bending mode or a piezoelectric actuator operable in normal mode is available to apply pressure on ink filled in a pressure chamber. Taking place of the piezoelectric actuator, a heater provided in a pressure chamber is also available. The heater produces a bubble in ink filled in the pressure chamber to eject ink from a nozzle.

Other embodiments based on the principles should be obvious to those of ordinary skill in the art. Such embodiments are intended to be covered by the claims.

What is claimed is:

1. An ink jet head for ejecting an ink droplet to form an image on a recording medium, comprising:

a pressure chamber to which ink is supplied;

an actuator which applies pressure on the ink filled in the pressure chamber;

a circuit which applies to the actuator a drive-waveform for sequentially ejecting one or more ink droplets to form one pixel on the recording medium, the one ink droplet having a volume V, expressed in units of a linear dimension cubed; and a nozzle plate, attached to the pressure chamber, which has a nozzle fluidly communicating with the pressure chamber to eject an ink droplet therefrom, the nozzle having a stepped inner surface shaped to include an inlet communicating with the pressure chamber and having a first sectional area in a plane orthogonal to an ink-ejecting direction, and to include an outlet communicating with the inlet and having a length Ln1, expressed in units of the linear dimension, in the ink-ejecting direction and a second sectional area C1, expressed in units of the linear dimension squared, in the orthogonal plane smaller than the first sectional area, the Ln1 , C1, and V satisfying the relationship of $0.5 \leq Ln1/(V/C1) \leq 1.0$.

2. The ink jet head according to claim 1, wherein the outlet is cylindrically formed to have a first diameter and the inlet is cylindrically formed to have a second diameter twice or more the first diameter.

3. The ink jet head according to claim 2, wherein the inlet has a length Ln2 which extends from the surface of the nozzle plate facing the pressure chamber to the stepped inner surface of the nozzle plate and is larger than the length Ln1 of the outlet.

4. The ink jet head according to claim 1, wherein the inlet has a length Ln2 which extends from the surface of the nozzle plate facing the pressure chamber to the stepped inner surface of the nozzle plate and is larger than the length Ln1 of the outlet.

5. The ink jet head according to claim 1, wherein the outlet is cylindrically formed.

6. The ink jet head according to claim 1, wherein the inlet is formed to be a shape selected from hollow shape, concave shape, truncated cone shape, truncated quadrangular pyramid.

7. An ink jet printing method for ejecting an ink droplet to form an image on a recording medium, comprising:

preparing an ink jet head comprising, a pressure chamber to which ink is supplied, an actuator which applies pressure on the ink filled in the pressure chamber, and a nozzle plate which has a nozzle fluidly communicating with the pressure chamber to eject an ink droplet therefrom, the nozzle having a stepped inner surface shaped to include an inlet communicating with the pressure chamber and having a first sectional area in a plane orthogonal to an ink-ejecting direction, and to include an outlet communicating with the inlet and having a length Ln1, expressed in units of a linear dimension, and a second sectional area C1, expressed in units of the linear dimension squared, in the orthogonal plane smaller than the first sectional area, and applying to the actuator a drive-waveform for sequentially ejecting one or more ink droplets to form one pixel on the recording medium, the one ink droplet having a volume V, expressed in units of the linear dimension cubed, the Ln1, C1, and V satisfying the relationship of $0.5 \leq Ln1/(V/C1) \leq 1.0$.

8. The method according to claim 7, wherein the outlet is cylindrically formed to have a first diameter and the inlet is cylindrically formed to have a second diameter twice or more the first diameter.

9. The method according to claim 8, wherein the inlet has a length Ln2 which extends from the surface of the nozzle plate facing the pressure chamber to the stepped inner surface of the nozzle and is larger than the length Ln1 of the outlet.

10. The method according to claim 7, wherein the inlet has a length Ln2 which extends from the surface of the nozzle plate facing the pressure chamber to the stepped inner surface of the nozzle and is larger than the length Ln1 of the outlet.

11. The method according to claim 7, wherein the outlet is cylindrically formed.

12. The method according to claim 7, wherein the inlet is formed to be a shape selected from hollow shape, concave shape, truncated cone shape, truncated quadrangular pyramid.

13. An ink jet head, comprising:

a pressure chamber to which ink is supplied;

an actuator for applying pressure on the ink supplied into the pressure chamber;

a nozzle plate, attached to the pressure chamber, having a nozzle fluidly communicating with the pressure chamber through which ink droplets are ejected, the nozzle having a stepped inner surface shaped to include an inlet communicating with the pressure chamber and having a first sectional area in a plane orthogonal to an ink-ejecting direction, and to include an outlet communicating with the inlet and having a length Ln1, expressed in units of a linear dimension, in the ink-ejecting direction and a second sectional area C1, expressed in units of the linear dimension squared, in the orthogonal plane smaller than the first sectional area; and a circuit for applying to the actuator a periodic drive signal to cause a periodic ejection of ink droplets through the nozzle, each of the ink droplets having a volume V, expressed in units of the linear dimension cubed, wherein Ln1, C1, and V satisfies the relationship of $0.5 \leq Ln1/(V/C1) \leq 1.0$.

* * * * *